US005182917A

United States Patent [19]

Kado et al.

[11] Patent Number: 5,182,917

[45] Date of Patent: Feb. 2, 1993

[54] FOOD SERVICE COUNTER OF THE ICE STORAGE TYPE

[75] Inventors: Syuji Kado, Toyoake; Susumu Tatematsu, Nagoya; Hideyuki Ikari, Kariya, both of Japan

[73] Assignee: Hoshizaki Denki Kabushiki Kaisha, Toyoake, Japan

[21] Appl. No.: 838,610

[22] Filed: Feb. 21, 1992

[51] Int. Cl.[5] ..... F25C 1/14; F25C 5/018

[52] U.S. Cl. ..... 62/137; 62/249; 62/258; 62/354

[58] Field of Search ..... 62/137, 249, 258, 344, 62/354

[56] References Cited

U.S. PATENT DOCUMENTS

| | | | |
|---|---|---|---|
| 3,196,628 | 7/1965 | Reynolds | 62/354 X |
| 3,643,454 | 2/1972 | Turner | 62/354 X |
| 3,686,890 | 8/1972 | Lyman | 62/354 X |
| 4,741,173 | 5/1988 | Neumann | 62/354 X |

FOREIGN PATENT DOCUMENTS

| | | | |
|---|---|---|---|
| 221768 | 9/1991 | Japan | 62/354 |

*Primary Examiner*—William E. Tapolcai
*Attorney, Agent, or Firm*—Nikaido, Marmelstein, Murray & Oram

[57] ABSTRACT

In an ice storage type food service counter with an ice storage tank, an ice supply device is provided to automatically produce chips of ice and supply the same into the ice storage tank, and an agitating device is provided to agitate and level the chips of ice stored in the ice storage tank. Under the ice storage tank, a water supply tank is arranged to store an amount of ice making water, and a discharge tank is arranged to store the water of melted ice discharged from the ice storage tank through a drain hole. Within the ice storage tank, there is provided an overlfow pipe having an upper end opening into the interior of the ice storage tank and extending downward to discharge therethrough the pieces of ice located above the upper end thereof into either one of the water supply tank or the discharge tank.

6 Claims, 4 Drawing Sheets

FOOD SERVICE COUNTER OF THE ICE STORAGE TYPE

BACKGROUND OF THE INVENTION

1. Field of the Invention

The present invention relates to a food service counter of the ice storage type for displaying containers, which can contain cold beverages and food, such as salad, on ice.

2. Description of the Prior Art

A conventional ice storage type food service counter of this kind is designed to display containers containing drink and food within an ice storage tank where chips of ice prepared by an ice making machine are manually carried and leveled.

Such a conventional ice storage type food service counter requires that chips of ice be manually carried into the ice storage tank and leveled, and that, every time ice melts away, ice be supplemented and leveled also manually.

SUMMARY OF THE INVENTION

The present invention has been achieved with a view to solving the above problems, and it is therefore a primary object of the present invention to provide an ice storage type food service counter which is desinged to automatically supply fresh ice into an ice storage tank and level it and to avoid overflowing of the ice from the ice storage tank.

It is a secondary object of the present invention to provide an ice storage type food service counter capable of eliminating energy consumption caused by excessive ice making.

According to the present invention, there is provided an ice storage type food service counter which comprises an ice storage tank arranged to store an amount of ice and having a drain hole at a bottom; an ice supply device for automatically producing chips of ice and supplying the same into the ice storage tank; an agitating device arranged within the ice storage tank for agitating and leveling the chips of ice stored in the ice storage tank; a water supply tank arranged below the ice storage tank to store an amount of ice making water for use in the ice supply device; a discharge tank arranged below the ice storage tank to store the water of melted ice discharged from the ice storage tank through the drain hole; and an overflow pipe having an upper end opening into the interior of the ice storage tank at a position lower than an upper edge of the ice storage tank and extending downward to discharge therethrough the pieces of ice located above the upper end thereof into either one of the water supply tank or the discharge tank.

According to one aspect of the present invention, there is provided an ice storage type food service counter wherein the overflow pipe is composed of a base pipe vertically extending upward through a bottom plate of the ice storage tank and fixed in place in a liquid-tight manner and an extension pipe movably coupled with an upper end of the base pipe to be adjustably positioned in the ice storage tank.

According to another aspect of the present invention, there is provided an ice storage type food service counter wherein the overflow pipe is in the form of a single pipe vertically extending upward through a bottom plate of the ice storage tank and fixed in place in a liquid-tight manner to discharge therethrough the pieces of ice located above the upper end thereof into the discharge tank, and wherein the drain hole is formed in a peripheral wall of the single pipe.

According to a further aspect of the present invention, there is provided an ice storage type food service counter which comprises an ice storage tank arranged to store an amount of ice and having a drain hole at a bottom; an ice supply device for automatically producing chips of ice and supplying the same into the ice storage tank; an agitating device arranged within the ice storage tank for agitating and leveling the chips of ice stored in the ice storage tank; a water supply tank arranged below the ice storage tank to store an amount of ice making water for use in the ice supply device; a discharge tank arranged below the ice storage tank; an overflow pipe having an upper end opening into the interior of the ice storage tank at a position lower than an upper edge of the ice storage tank and extending downward to discharge therethrough the pieces of ice located above the upper end thereof into either one of the water supply tank or the discharge tank; an ice detection device arranged to detect the pieces of ice passing through the overflow pipe; and a control device for deactivating the ice supply device when the pieces of ice passing through the overflow pipe are detected by the ice detection device.

According to a still further aspect of the present invention, there is provided an ice storage type food service counter wherein the ice detection device comprises an ice detection plate swingably mounted within an intermediate portion of the overflow pipe by means of a horizontal shaft to close the ice passage in the overflow pipe in a condition where it is balanced by weight of itself and to open the ice passage when moved by the pieces of ice applied thereto and a switch arranged to be operated by movement of the detection plate.

According to a further aspect of the present invention, there is provided an ice storage type food service counter wherein the ice detection device comprises a casing integrally formed with an intermediate portion of the overflow pipe, a plurality of blades radially extending from a horizontal shaft rotatably mounted within the casing and being balanced in such a manner that one of the blades is horizontally located across the passage in the overflow pipe, a shade plate fixed to the horizontal shaft perpendicularly thereto and provided with a recess, and a photointerrupter mounted on the casing to cooperate with the shade plate.

DESCRIPTION OF THE PREFERRED EMBODIMENTS

Figure 1:
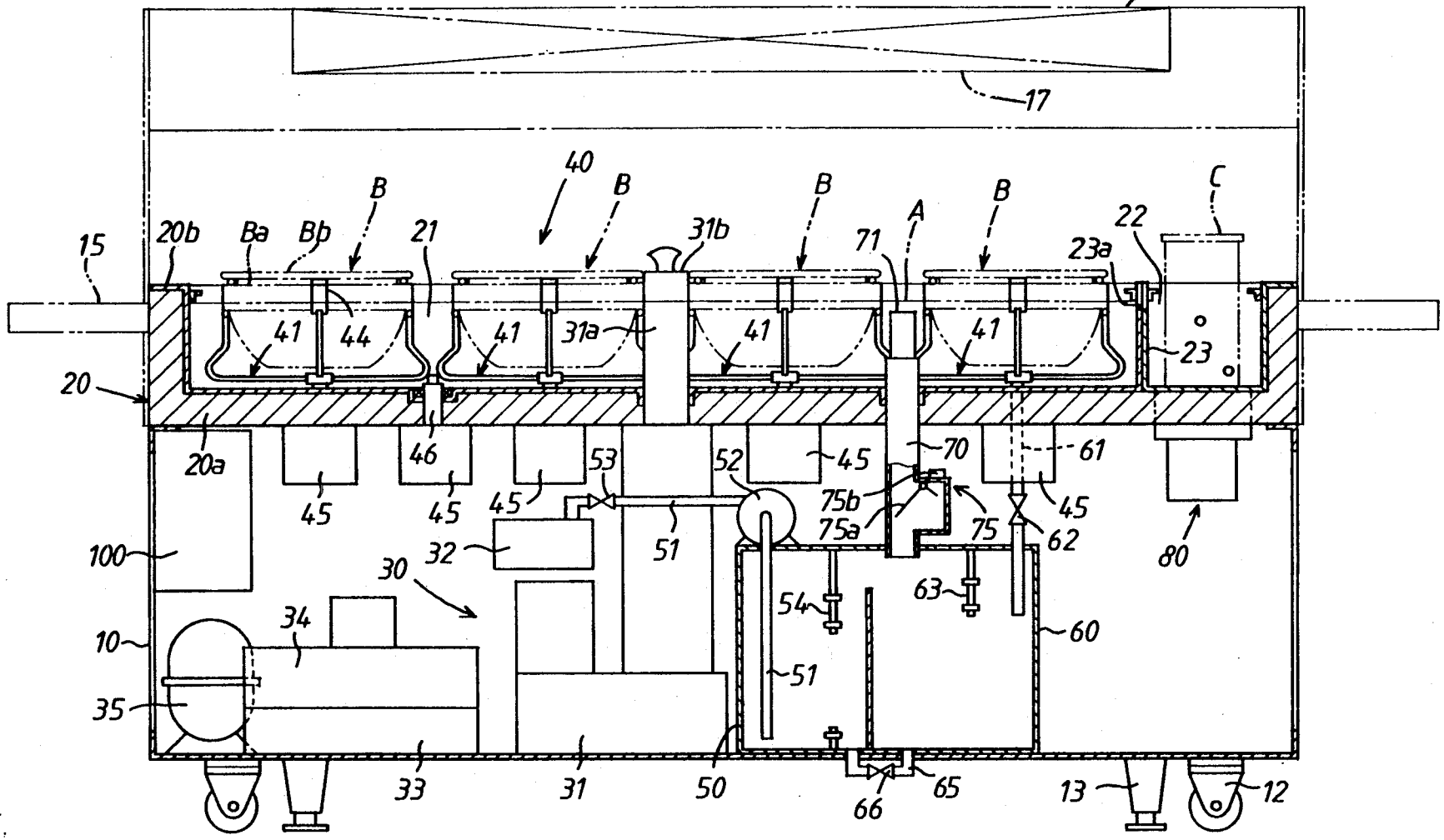
FIG. 1 is a vertical sectional view illustrating the whole construction of an embodiment of an ice storage type food service counter according to the present invention.

Referring now to the drawings, a preferred embodiment of the present invention will be described with reference to FIGS. 1 and 2. As shown in FIG. 1, an ice storage tank 20 is mounted on a support frame 10 which is supported on the floor by casters 12 and legs 13. Provided in the support frame 10 under the ice tank 20 are an ice supply device 30 for automatically supplying chips of ice into the ice storage tank 20, a water supply tank 50, a discharge tank 60, a control device 100, etc. as well as the essential portions of an agitating device 40 which agitates chips of ice supplied into the ice storage tank 20 to level it. A table 15 is provided around the ice storage tank 20. Above the ice storage tank 20 is located an open type hood 16 provided with a lighting equipment 17.

Figure 2:
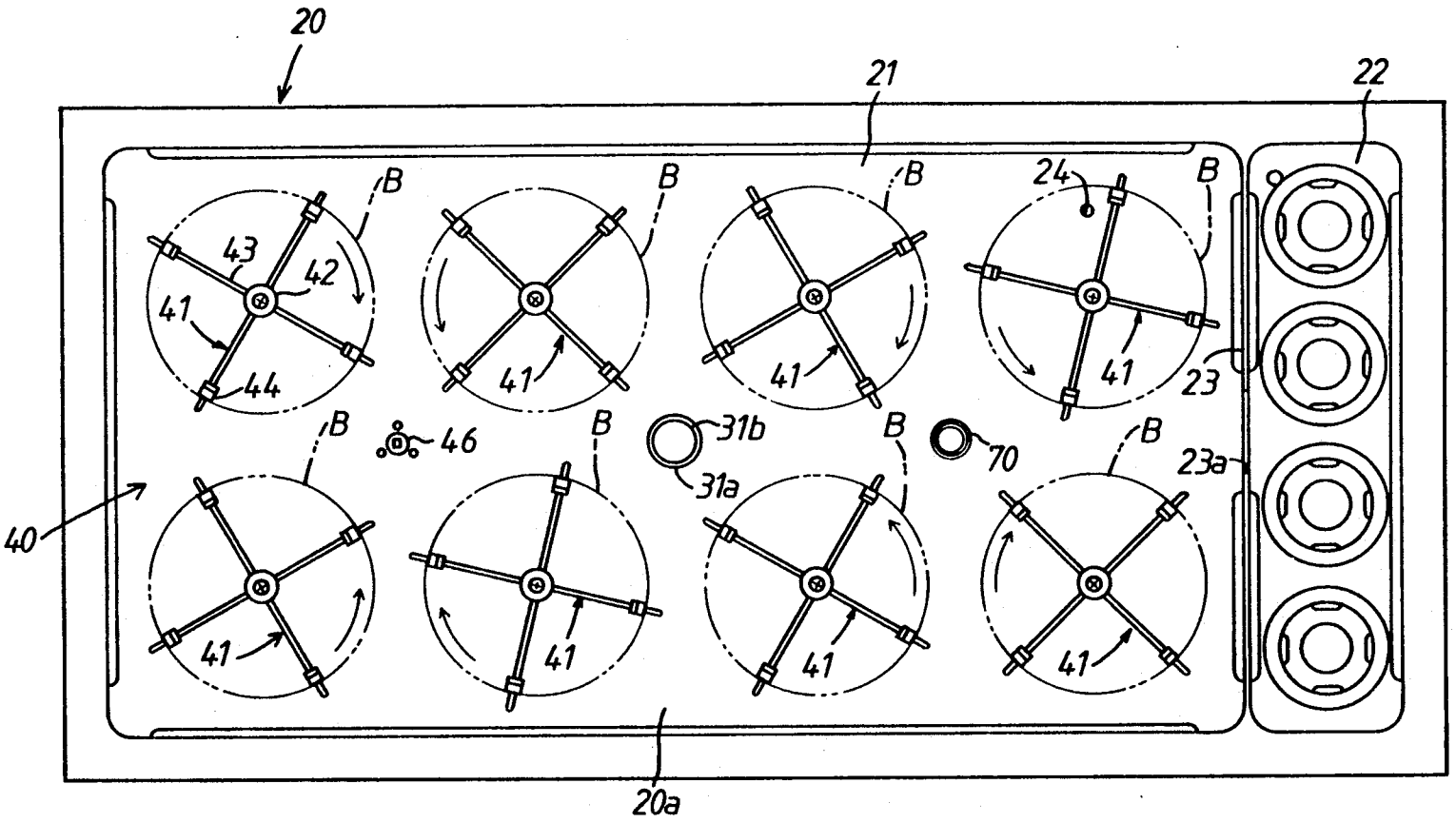
FIG. 2 is a plan view of the food service counter.

As shown in FIGS. 1 and 2, the ice storage tank 20 comprises an insulative outer box lined with a rust preventive material, such as stainless steel or resin, shaped into a rectangular shallow box with top open. Part of the line of the ice tank 20 stands upright to form a partition 23 which separates the interior of the ice tank 20 into a large main tank 21 and a small sub-tank 22. A notch 23*a* is formed in the center of the upper edge of the partition 23 to permit communication between both tanks 21 and 22. The lower edge of the notch 23*a* is positioned slightly lower than a predetermined ice level A to be described later. As shown in FIG. 2, a drain hole 24 is formed in the bottom of main tank 21.

The ice supply device 30 in this embodiment is in the form of a well-known auger type ice making machine whose essential portions include an ice making mechanism 31, a water tank 32, a condenser 33, a cooling fan 34 and a compressor 35, which are all disposed within the support frame 10, except for the top portion of the ice making mechanism 31. The ice making mechanism 31 comprises an evaporator, an auger and a drive motor. A vertical cylinder 31*a* extends into the main tank 21 through a bottom plate 20*a* of the ice storage tank 20 in a liquid-tight manner. The vertical cylinder 31*a* has an ice delivery port 31*b* provided at the top, slightly higher than an upper edge 20*b* of the ice storage tank 20. As will be described later, ice making water supplied to the water tank 32 from the water supply tank 50 is supplied to the ice making mechanism 31 where it is formed into chips of ice of the size of about 1 to 2 $cm^3$, and the chips of ice are carried up to fall into the main tank 21 from the delivery port 31*b*.

As shown in FIGS. 1 and 2, the agitating device 40 comprises agitators 41 respectively mounted on a plurality of drive shafts 46, and drive motors 45 for rotating the agitators 41. In this embodiment, there are nine geared motors used as the drive motors 45, with their output shafts being the drive shafts 46. Each drive motor 45 is fixed to the bottom of the ice storage tank 20, with the drive shaft 46 extending into the ice storage tank 20 through the bottom plate 20*a* in a liquid-tight manner. As shown in FIG. 2 of a plan view, the individual drive shafts 46 are arranged eight in two rows at equal lateral and longitudinal distances and the last one located just the center of those four drive shafts which are located away from the sub-tank 22 than the other four. Each drive shaft 46 has a rectangular free end where the associated agitator 41 is to be mounted. Although in this embodiment, each drive shaft 46 is driven by a single drive motor 45 and its rotational speed and direction can be finely adjusted by the control device 100, the individual drive shafts 46 may be linked by a link mechanism to be driven by fewer drive motors.

As shown in FIGS. 1 and 2, the agitator 41 has a boss section 42 to be detachably attached to the free end of the drive shaft 46, four arm portions 43 each having one end fixed to the boss section 42 and extending radially before bent upward, and stoppers 44 pivoted to the upper ends of the respective arm portions 43. Each boss section 42 has a rectangular hole in the center in which the top end of the drive shaft 46 is to be fitted, and is securely fastened to the drive shaft 46 by means of a screw. The rotational speed of the agitator 41 is several rotations per minute. Although in this embodiment the rotational directions of the individual agitators 41 are determined in such a manner that the adjacent agitators rotate in the opposite directions as illustrated in FIG. 2, the agitators may be arranged to rotate in various other direction patterns.

Containers B each comprise a transparent glass support container Ba and a service container Bb. The support container Ba is attached to the associated agitator 41 with its edge portion held by the stoppers 44, and is designed to receive the service container Bb which contains cold food and drink, such as salad. Although the agitator 41 is not mounted on the drive shaft 46 at the left center in FIG. 2 in this embodiment, the drive shaft 46 is reserved for the use to mount, for example, a large agitator 41 for supporting a container B of large diameter (not shown), in which case small agitators (not shown) are mounted on the surrounding four drive shafts 46, or no agitators are mounted thereon. Alternatively, the small agitators for supporting containers of small diameter may be mounted on those five drive shafts 46.

Although the water supply tank 50 and the discharge tank 60 are provided by separating a single container with a partition as shown in FIG. 1, they may be provided as independent and separate tanks. The tanks 50 and 60 each have a water supply level detector 54 and a water discharge level detector 63, and the bottoms of both tanks 50 and 60 communicate with each other through a communication path 65 provided with a solenoid valve 66. The tanks 50 and 60 are each provided with a drain cock (not shown). Water in the water supply tank 50 is supplied to the water tank 32 via a water supply pump 52 and a supply line 51 equipped with a water supply solenoid valve 53. The level of water in the water tank 32 is kept almost constant by controlling the pump 52 and the solenoid valve 53 by means of a float switch (not shown) which is activated when the water level in the water tank 32 becomes a predetermined level. The drain hole 24 in the bottom of the main tank 21 communicates with the interior of the discharge tank 60 through a discharge pipe 61 provided with a discharge solenoid valve 62, so that water produced by melted ice in the main tank 21 is discharged into the discharge tank 60.

Figure 3:
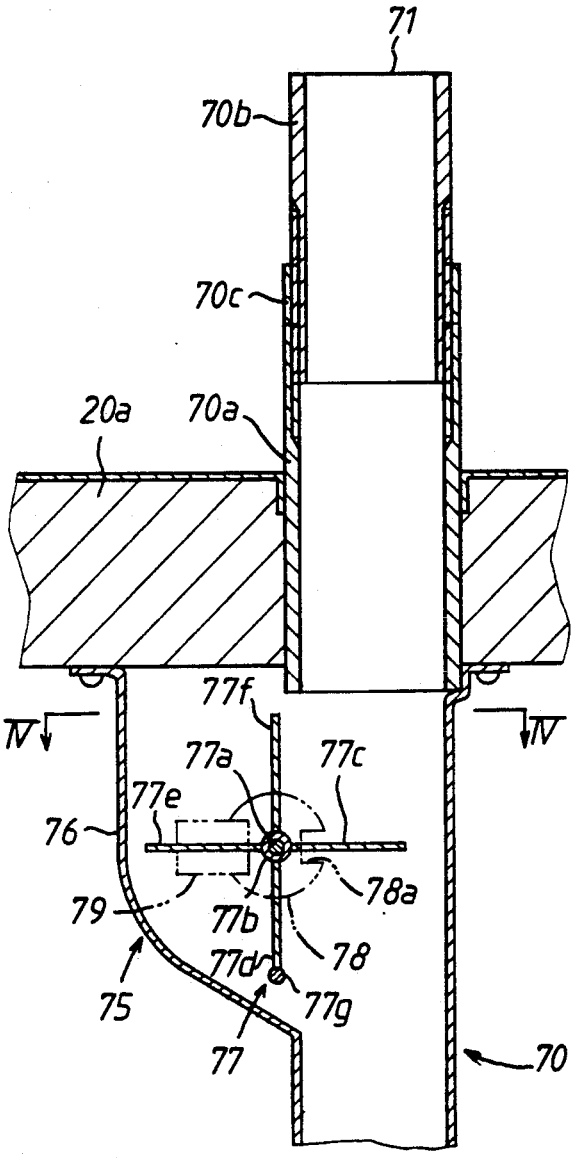
FIG. 3 is an enlarged sectional view of a modification of an ice detection device shown in FIG. 1.

As shown in FIGS. 1 and 2, an overflow pipe 70 is provided vertically in the ice storage tank 20, extending upward through the bottom plate 20*a* of tank 20 at the center of the four drive shafts 46. The overflow pipe 70 has an opening 71 at its upper end, slightly lower than the upper edge 20*b* of the ice tank 20, and a lower end opening into the interior of the discharge tank 60. When the level A of chips of ice, supplied from the ice supply device 30 into the main tank 21 and leveled by the agitating device 40, reaches a predetermined level slightly higher than the opening 71 at the upper end of the overflow pipe 70 (but lower than the upper edge 20*b*), individual chips of ice fall into the discharge tank 60 through the overflow pipe 70. In addition, the height of overflow pipe 70 can be adjusted in such a construction as shown in FIG. 3.

Provided at an intermediate portion of overflow pipe 70 is an ice detection device 75 which comprises an ice detection plate 75*a* swingably mounted within the intermediate portion of overflow pipe 70 by means of a horizontal shaft and extending downward to close the ice passage in overflow pipe 70 in a condition where it is being balanced by weight of itself, and a proximity switch 75*b* arranged to be operated by movement of the ice detection plate 75*a*. When applied with the pieces of ice falling into the overflow pipe 70, the detection plate 75*a* is moved to open the ice passage in overflow pipe 70, and in turn, the proximity switch 75*b* is operated to apply a detection signal to the control device 100. The control device 100 is provided with a timer to be operated in response to the detection signal applied thereto from the proximity switch 75*b*. When applied with the detection signal from the proximity switch 75*a*, the control device 100 acts to temporarily deactivate the ice supply device 80 and activate it upon lapse of a predetermined time measured by the timer. In addition, the sub-tank 22 is formed to contain four dressing containers C, and an agitating device 80 is provided under the sub-tank 22.

When the ice storage type food service counter is operated, water in the water supply tank 50 is fed by operation of the pump 52 to the water tank 32 from which it is supplied to the ice making mechanism 31 to be formed into chips of ice. The chips of ice are then supplied into the main tank 21 from the ice delivery port 31*b*. Simultaneously, the supplied chips of ice are automatically distributed all over the interior of the main tank 21 and leveled by rotation of the agitators 41. When the ice level A in the main tank 21 reaches a predetermined level, those pieces of ice above the level A fall into the discharge tank 60 through the overflow pipe 70. When the passing of ice is detected by the ice detection device 75, the control device 100 is applied with a detection signal from the detection device 75.

In response to the detection signal, the control device 100 acts to temporarily deactivate the ice making mechanism 31 for the predetermined time thereby to avoid overflow of the ice from the upper edge 20*b* of ice tank 20 and to eliminate energy consumption caused by excessive ice making. In such a situation, the food service counter is used with the food and drink containing service containers Bb placed in the support containers Ba. In use of the food service counter, the service containers Bb are respectively placed in the support containers Ba to contain the food and drink therein. In accordance with such use of the food service counter, the level A of a ice tank 20 can be varied by adjustment of the overflow pipe 70 at its upper portion 71. The control device 100 may be arranged to reset the timer at each time when applied with the detection signal from the ice detection device 75. Alternatively, the control device 100 may be arranged to maintain the operation of the timer when applied with the detection signal during measurement of the predetermined time.

During use of the food service counter, fresh chips of ice fall into the ice tank 20 from the ice delivery port 31*b* piece by piece, and the pieces of ice in tank 20 are moved around by operation of the agitators 41. Thus, an excellent display effect can be obtained as well as the food and drink in the service containers Bb can be refrigerated. The water of melted ice in the main tank 21 is discharged from the discharge hole 24 into the discharge tank 60 through the discharge pipe 61 and solenoid valve 62. When the level of water in the discharge tank 60, which is detected by a water discharge level detector 63, becomes the highest allowable level, the control device 100 acts to close the solenoid valve 62 so as to prevent leakage of the water from the discharge tank 60. In this instance, the food service counter can be used with the agitating device 40 in operation for some time.

Figure 4:
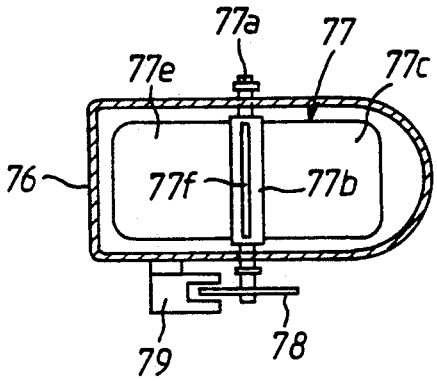
FIG. 4 is a cross-sectional view taken along line IV—IV in FIG. 3.

In FIGS. 3 and 4, there is a modification of the ice detection device 75, wherein a casing 76 is integrally formed with an upper portion of the lower section of overflow pipe 70 to contain a detection assembly 77 and secured at its upper end to the bottom plate 20*a* of ice storage tank 20. The detection assembly 77 includes a horizontal shaft 77*a* rotatably mounted on the casing 76 at its opposite ends and four blades 77*c*–77*f* radially outwardly extending from a hub 77*b* fixed to the horizontal shaft 77*a*. The blade 77*d* is provided at its free end with a light weight element 77*g* which acts to balance the blades in such a manner that the blade 77*c* is horizontally placed across the passage in overflow pipe 70. As shown in FIG. 4, a circular shade plate 78 formed with a recess 78*a* is fixed to one end of the horizontal shaft 77*a* for rotation therewith, and a photo-interrupter 79 is attached to the casing 76 to cooperate with the shade plate 78. As shown in FIG. 3, the recess 78*a* of shade plate 78 is normally displaced from the photo-interrupter 79. When the shade plate 78 is rotated with the detection assembly 77, the photo-interrupter 79 cooperates with the recess 78*s* of shade plate 78 to produce a detection signal therefrom.

As shown in FIG. 3, the upper portion of the overflow pipe 70 is composed of a base pipe 70*a* vertically extending upward through the bottom plate 20*a* of tank 20 in a liquid-tight manner and an extension pipe 70*b* threaded into the base pipe 70*a*. When it is desired to adjust the height of the opening 71 of overflow pipe 70, the extension pipe 70*b* is vertically moved by rotation relative to the base pipe 70*a* and fixed to the base pipe 70*a* at the moved position by means of a fastening nut 70*c*.

Assuming that the chips of ice have fallen into the overflow pipe 70 from its opening 71 as described above, the blade 77*c* is moved by the chips of ice abutted thereto to rotate the shade plate 78. Since the blades of the detection assembly 77 are balanced with the light weight element 77*g*, the shade plate 78 is rotated by a small amount of ice chips or one piece of ice abutted thereto to operate the photo-interrupter 79. Thus, the photo-interrupter 79 is operated to detect the ice pieces passing through the overflow pipe 70 and to apply a detection signal to the control device 100. The control device 100 is provided with a timer to be operated in response to the detection signal applied thereto from the ice detection device 75. When applied with the detection signal from the detection device 75, the control device 100 acts to temporarily deactivate the ice supply device 30 and activate it upon lapse of a predetermined time measured by the timer.

As described above, the ice detection device 75 acts to detect a small amount of ice chips falling into the upper opening of overflow pipe 70 thereby to deactivate the ice making mechanism 31 under control of the control device without any delay of time. This is effective to avoid energy consumption caused by excessive ice making. The other construction and operation are substantially the same as those of the embodiment shown in FIGS. 1 and 2.

Figure 5:
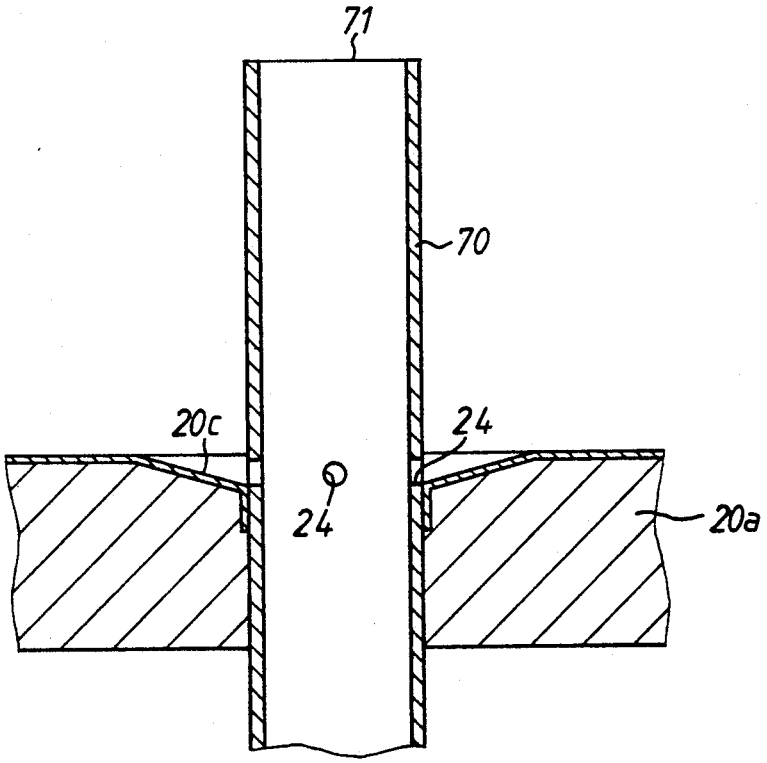
FIG. 5 is an enlarged sectional view of a modification of an overflow pipe and a discharge hole in FIG. 1.

FIG. 5 illustrates a modification of the overflow pipe 70 and the discharge hole 24, wherein the overflow pipe 70 is in the form of a single pipe vertically extending upward through the bottom plate 20*a* of ice storage tank 20 in a liquid-tight manner. In this modification, the bottom of main tank 21 is formed with a conical concave 20*c* in surrounding relationship with the overflow pipe 70, and the discharge in the bottom of main tank 21 is replaced with radial holes 24 formed in the peripheral wall of overflow pipe 70 and located in the conical concave 20*c*. In use of the food service counter, the water of melted ice in tank 20 is stored in the conical concave 20*c* and discharged from the radial holes 24 into the discharge tank 60 through the overflow pipe 70, while the chips of ice located above the upper opening 71 are discharged into the discharge tank 60 through the overflow pipe 70 to maintain the level of ice in main tank 21 at the predetermined level.

Although in the above embodiment and modifications only the overflow pipe 71 has been extended upward through the bottom plate 20*a* of ice storage tank 20, a plurality of overflow pipes may be provided. Alternatively, the overflow pipe 70 may be arranged along an internal side wall of the ice storage tank 20.

What is claimed is:

1. An ice storage type food service counter comprising:

an ice storage tank arranged to store an amount of ice and having a drain hole at a bottom;

an ice supply device for automatically producing chips of ice and supplying the same into the ice storage tank;

an agitating device arranged within the ice storage tank for agitating and leveling the chips of ice stored in the ice storage tank;

a water supply tank arranged below the ice storage tank to store an amount of ice making water for use in the ice supply device;

a discharge tank arranged below the ice storage tank to store the water of melted ice discharged from the ice storage tank through the drain hole; and an overflow pipe having an upper end opening into the interior of the ice storage tank at a position lower than an upper edge of the ice storage tank and extending downward to discharge the chips of ice located above its upper end into either one of the water supply tank or the discharge tank.

2. An ice storage type food service counter as claimed in claim 1, wherein the overflow pipe is composed of a base pipe vertically extending upward through a bottom plate of the ice storage tank and fixed in place in a liquid-tight manner and an extension pipe movably coupled with an upper end of the base pipe to be adjustably positioned in the ice storage tank.

3. An ice storage type food service counter as claimed in claim 1, wherein the overflow pipe is in a single pipe vertically extending upward through a bottom plate of the ice storage tank and fixed in place in a liquid-tight manner to discharge the pieces of ice located above the upper end thereof into the discharge tank, and wherein the drain hole is formed in the peripheral wall of the single pipe.

4. An ice storage type food service counter comprising:

an ice storage tank arranged to store an amount of ice and having a drain hole at a bottom;

an ice supply device for automatically producing chips of ice and supplying the same into the ice storage tank;

an agitating device arranged within the ice storage tank for agitating and leveling the chips of ice stored in the ice storage tank;

a water supply tank arranged below the ice storage tank to store an amont of ice making water for use in the ice supply device;

a discharge tank arranged below the ice storage tank;

an overflow pipe having an upper end opening into the interior of the ice storage tank at a position lower than an upper edge of the ice storage tank and extending downward to discharge therethrough the pieces of ice located above the upper end thereof into either one of the water supply tank or the discharge tank;

an ice detection devic arranged to detect the pieces of ice passing through the overflow pipe; and a control devic for deactivating the ice supply device when the pieces of ice passing through the overflow pipe is detected by the ice detection device.

5. An ice storage type food service counter as claimed in claim 4, wherein the ice detection device comprises an ice detection plate swingably mounted within an intermediate portion of the overflow pipe by means of a horizontal shaft to close the ice passage in the overflow pipe in a condition where it is balanced by a weight of itself and to open the ice passage when moved by the pieces of ice applied thereto and a switch arranged to b operated by movement of the detection plate.

6. An ice storage type food service counter as claimed in claim 4, wherein the ice detection device comprises a casing integrally formed with an intermediate portion of the overflow pipe, a plurality of blades radially extending from a horizontl shaft rotatably mounted within the casing and being balanced in such a manner that one of the blades is horizontally located across the passage in the overflow pipe, a shade plate fixed to the horizontal shaft perpedicularly thereto and provided with a recess, and a photo-interrupter mounted on the casing to cooperate with the shade plate.

* * * * *